US008555983B2

(12) United States Patent
Palacios

(10) Patent No.: US 8,555,983 B2
(45) Date of Patent: Oct. 15, 2013

(54) APPARATUS AND METHOD FOR ACTIVATING AND DEACTIVATING A DOWNHOLE TOOL

(75) Inventor: Arturo Palacios, Laredo, TX (US)

(73) Assignee: Smith International, Inc., Houston, TX (US)

( * ) Notice: Subject to any disclaimer, the term of this patent is extended or adjusted under 35 U.S.C. 154(b) by 270 days.

(21) Appl. No.: 12/945,439

(22) Filed: Nov. 12, 2010

(65) Prior Publication Data

US 2011/0114334 A1 May 19, 2011

Related U.S. Application Data

(60) Provisional application No. 61/261,641, filed on Nov. 16, 2009.

(51) Int. Cl.
*E21B 34/00* (2006.01)
*E21B 34/06* (2006.01)
*E21B 10/32* (2006.01)

(52) U.S. Cl.
USPC ..... 166/373; 166/316; 166/318; 166/319; 175/268

(58) Field of Classification Search
USPC ..... 166/316, 318, 319, 373, 379, 381; 175/266, 268, 271
See application file for complete search history.

(56) References Cited

U.S. PATENT DOCUMENTS 4,427,070 A * 1/1984 O'Brien ..... 166/317
4,574,894 A 3/1986 Jadwin
6,006,838 A * 12/1999 Whiteley et al. ..... 166/306
6,065,541 A * 5/2000 Allen ..... 166/318
6,173,795 B1 1/2001 McGarian et al.
6,253,861 B1 7/2001 Carmichael et al.
6,289,999 B1 9/2001 Dewey et al.
6,349,763 B1 * 2/2002 Estep et al. ..... 166/66.4
6,732,817 B2 5/2004 Dewey et al.
7,628,213 B2 * 12/2009 Telfer ..... 166/381
7,954,555 B2 * 6/2011 Ashy et al. ..... 166/386
7,975,783 B2 * 7/2011 Fanuel et al. ..... 175/285
2006/0124317 A1 * 6/2006 Telfer ..... 166/381
2007/0095573 A1 * 5/2007 Telfer ..... 175/57
2007/0107944 A1 * 5/2007 Lee ..... 175/317
2009/0056952 A1 3/2009 Churchill
2009/0084555 A1 * 4/2009 Lee ..... 166/319
2011/0232969 A1 * 9/2011 Laird et al. ..... 175/57

OTHER PUBLICATIONS

International Search Report issued in corresponding International Application No. PCT/US2010/056707; Dated Jun. 16, 2011 (3 pages).
Written Opinion of the International Searching Authority issued in corresponding International Application No. PCT/US2010/056707; Dated Jun. 16, 2011 (4 pages).

* cited by examiner

*Primary Examiner* — Giovanna Wright
*Assistant Examiner* — Michael Wills, III
(74) *Attorney, Agent, or Firm* — Osha Liang LLP

(57) ABSTRACT

A control mechanism for a downhole tool including a mandrel having a throughbore, at least one activation port, and at least one bypass port, a first sleeve detachably mounted within the throughbore at a first position and moveable to a second position, the first sleeve having a first seat, and a second sleeve detachably mounted within the throughbore at a third position located axially above the first position and moveable to a fourth position, the second sleeve having a second seat. A method of hydraulically actuating and deactuating a downhole tool, the method including disposing the downhole tool and a control mechanism in a well.

20 Claims, 12 Drawing Sheets

APPARATUS AND METHOD FOR ACTIVATING AND DEACTIVATING A DOWNHOLE TOOL

BACKGROUND OF INVENTION

1. Field of the Invention

Embodiments disclosed herein generally relate to a control mechanism for a downhole tool. Specifically, embodiments disclosed herein relate to a control mechanism and method for actuating or de-actuating a downhole tool by dropping objects, such as drop balls, into a well. More specifically, embodiments disclosed herein relate to a control mechanism for selective actuation of a downhole tool while providing full fluid flow through the downhole tool when the tool is either actuated or de-actuated.

2. Background Art

In the drilling of oil and gas wells, a number of downhole tools function by actuating specific components while being operated in a well borehole. For example, a borehole underreamer or stabilizer may include blocks or blades which may be selectively extended outward from a body of the tool. Specifically, when the underreamer or stabilizer is in a de-actuated or collapsed state, the diameter of the tool is sufficiently small to allow the tool to pass through an existing cased borehole. In contrast, when the underreamer is an actuated or expanded state, the blocks or blades extend from the body of the tool to engage a portion of a borehole. Thus, in the actuated position, the underreamer enlarges the borehole diameter as the tool is rotated and lowered in the borehole. Accordingly, the borehole may be cased with comparatively larger diameter casing than would have been possible otherwise, thereby providing more flow area for the production of oil and gas.

One method of actuating a downhole tool is the application of a specific level of fluid pressure to hydraulic components included in (or connected to) the tool. For example, in the case of an underreamer, the blocks or blades may be extended when fluid pressure is applied to hydraulic cylinders included in the tool. However, one disadvantage to this method is that no other downhole tools which are also actuated by fluid pressure (for example, adjustable stabilizers) may be operated without also operating the underreamer. Thus, in order to use different tools actuated by fluid pressure, the drill string has to be tripped out of the borehole, a first tool is removed from the string, and a second tool is then attached to the drill string. The whole assembly is then tripped back into the borehole. Obviously, this procedure can be costly and time-consuming, especially if the depth of the borehole is in the thousands of feet.

Another method of actuating a downhole tool is the use of drop objects and seats. For example, an underreamer may include a seat configured to receive a drop ball. When the ball is dropped into the well, the ball may travel through the borehole and become seated in the seat, thereby obstructing fluid flow through an inner diameter of the seat. By obstructing the fluid flow, fluid pressure may be applied to hydraulic components within the tool, thus actuating the tool. However, this approach may result in the reduction or stoppage of fluid flow below the tool, which may be required for other drilling operations and/or tools.

Accordingly, there exists a need for an actuation mechanism for actuating and de-actuating a downhole tool while allowing fluid flow below the tool

SUMMARY OF INVENTION

In one aspect, embodiments disclosed herein relate to a control mechanism for a downhole tool including a mandrel having a throughbore, at least one activation port, and at least one bypass port, a first sleeve detachably mounted within the throughbore at a first position and moveable to a second position, the first sleeve having a first seat, and a second sleeve detachably mounted within the throughbore at a third position located axially above the first position and moveable to a fourth position, the second sleeve having a second seat.

In another aspect, embodiments disclosed herein relate to a method of hydraulically actuating and deactuating a downhole tool, the method including disposing the downhole tool and a control mechanism in a well, wherein the control mechanism includes a mandrel, a first sleeve detachably mounted within a throughbore of the mandrel and having a first seat, and a second sleeve detachably mounted within the throughbore and having a second seat, wherein the mandrel includes at least one activation port initially blocked by the first sleeve, dropping a first drop object of a first size into the well, seating the first drop object in the first seat, applying a first predetermined hydraulic force against the first drop object to move the first sleeve axially downward within the mandrel to a first stop position, wherein moving the first sleeve to the first stop position opens the at least one activation port, flowing a fluid through the at least one activation port to actuate the downhole tool, dropping a second drop object of a second size into the well, seating the second drop object in the second seat, and applying a second predetermined hydraulic force against the second drop object to move the second sleeve axially downward within the mandrel to a second stop position, wherein moving the second sleeve to the second stop position blocks the at least one activation port.

In yet another aspect, embodiments disclosed herein relate to a control mechanism for a downhole tool including a mandrel having a throughbore, at least one activation port, and at least one bypass port, a first sleeve detachably mounted within the throughbore at a first position and moveable to a second position, the first sleeve having a first seat, a second sleeve detachably mounted within the throughbore at a third position located axially above the first position and moveable to a fourth position, and a third sleeve detachably mounted within the second sleeve, the third sleeve having a second seat.

DETAILED DESCRIPTION

Embodiments disclosed herein relate to a control mechanism for a downhole tool. Specifically, embodiments disclosed herein relate to a control mechanism for actuating or de-actuating a downhole tool. More specifically, embodiments disclosed herein relate to a control mechanism for selectively actuating a downhole tool while providing full fluid flow through the downhole tool when the tool is either actuated or de-actuated.

U.S. Pat. No. 6,732,817, which is assigned to the present assignee, is directed to an expandable underreamer/stabilizer and is incorporated by reference herein in its entirety. U.S. Pat. No. 6,289,999, which is assigned to the present assignee, is directed to a fluid flow control device and methods for selective actuation of valves and hydraulic drilling tools and is incorporated by reference herein in its entirety.

FIGS. 1-5 depict cross-sectional views of a control mechanism for actuating and de-actuating a tool 500, in accordance with one embodiment of the present disclosure. Specifically, FIGS. 1-5 depict the components of the tool 500 at multiple points in time or stages during use of the tool 500.

Figure 1:
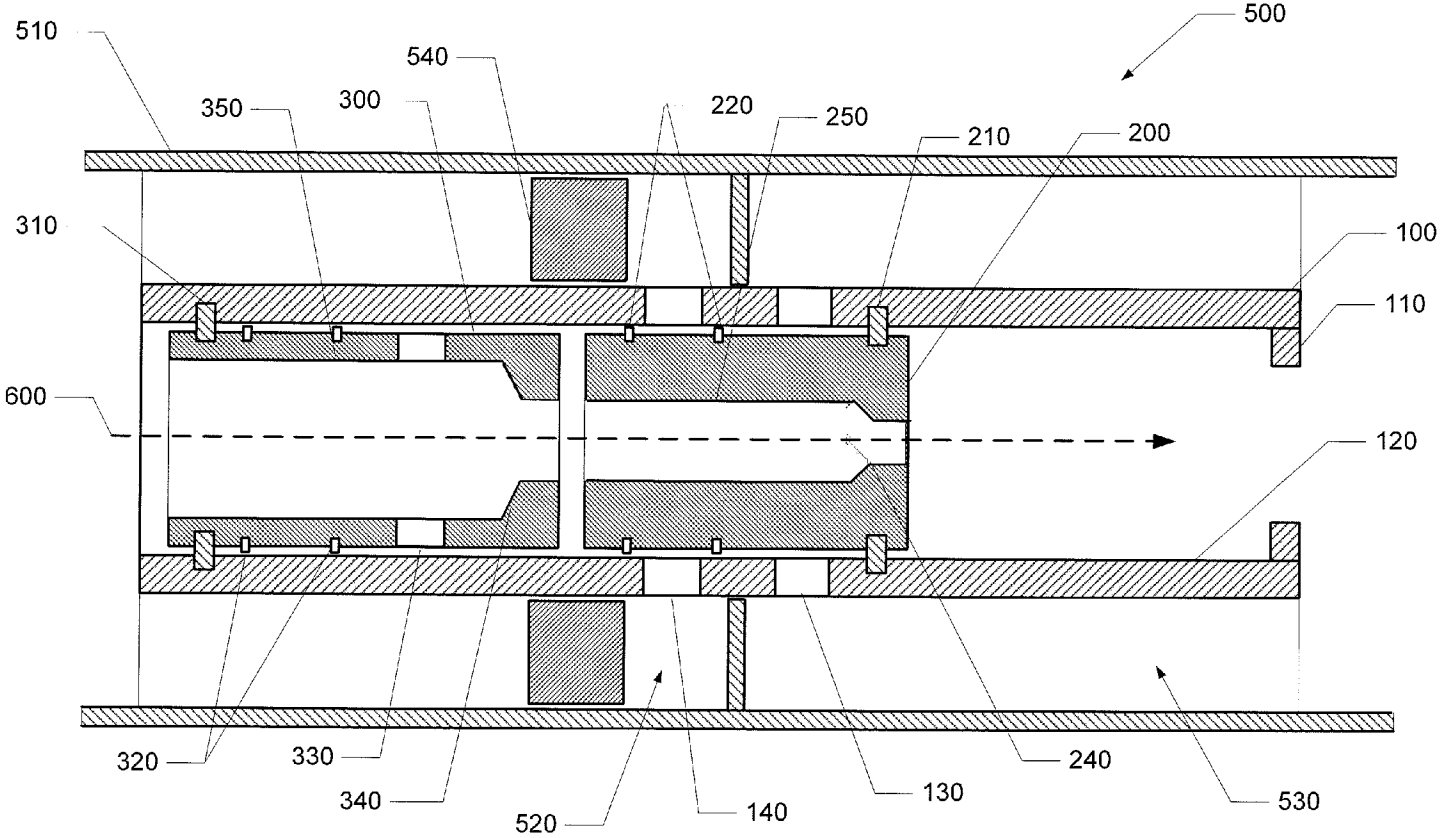
FIG. 1 shows a cross-sectional view of a first state of a downhole tool in accordance with an embodiment of the present disclosure.

FIG. 1 depicts an initial state of the tool 500 located in a well, in accordance with embodiments disclosed herein. As shown, the tool 500 includes a mandrel 100 mounted within a tool body 510. Disposed proximate to an upper portion of the mandrel 100 is a piston 540 configured to slide axially within a piston chamber 520. The piston 540 and the piston chamber 520 are described below with reference to FIG. 4. Further, disposed proximate a lower portion of the mandrel 100 is a bypass chamber 530. The bypass chamber 530 is described below with reference to FIG. 3.

The mandrel 100 includes a shoulder 110 and a throughbore 120. As shown, the throughbore 120 allows fluid flow 600 to pass through the tool 500. The mandrel 100 also includes one or more activation ports 140 disposed proximate to the upper portion of the mandrel 100 and radially extending from an inner surface of the mandrel to an outer surface of the mandrel. The mandrel 100 further includes one or more bypass ports 130 disposed proximate to the lower portion of the mandrel 100 and radially extending from the inner surface of the mandrel to the outer surface of the mandrel. In one or more embodiments, the activation ports 140 allow fluid flow between the throughbore 120 and the piston chamber 520. Further, the bypass ports 130 allow fluid flow between the throughbore 120 and the bypass chamber 530.

In one or more embodiments, a first sleeve 200 and a second sleeve 300 are disposed within the throughbore 120. The first sleeve 200 is positioned axially above the second sleeve 300, and both sleeves 200, 300 are configured to slide axially within the throughbore 120 when a predetermined pressure is applied from above the tool 500, as will be described in greater detail below. The first sleeve 200 is initially coupled to the mandrel 100 by a first shearing device 210. The first shearing device 210 may be any device (or combination of devices) known in the art configured to maintain the first sleeve 200 in an initial position until a first predetermined pressure is applied from above the tool 500.

The second sleeve 300 is initially coupled to the mandrel 100 by a second shearing device 310 at a location axially above the first sleeve 200. The second shearing device 310 may be any device configured to maintain the second sleeve 300 in an initial position until a second predetermined pressure is applied from above the tool 500. The first shearing device 210 and/or the second shearing device 310 may be, for example, shear pin(s), shear ring(s), shear screw(s), and the like.

The first sleeve 200 includes a first sleeve throughbore 250, a first seat 240 and one or more seals 220. The seals 220 may be any device(s) configured to prevent or minimize fluid flow between the inner surface of the mandrel 100 and the outer surface of the first sleeve 200, for example, an O-ring. The first seat 240 is described below with reference to FIG. 2.

The second sleeve 300 includes a second sleeve throughbore 350, one or more radial ports 330, a second seat 340, and one or more seals 320. The seals 320 may be any device(s) configured to prevent or minimize fluid flow between the inner surface of the mandrel 100 and the outer surface of the second sleeve 300, for example, an O-ring. The second seat 340 is described below with reference to FIG. 5. The radial ports 330 are described below with reference to FIG. 6.

Figure 2:
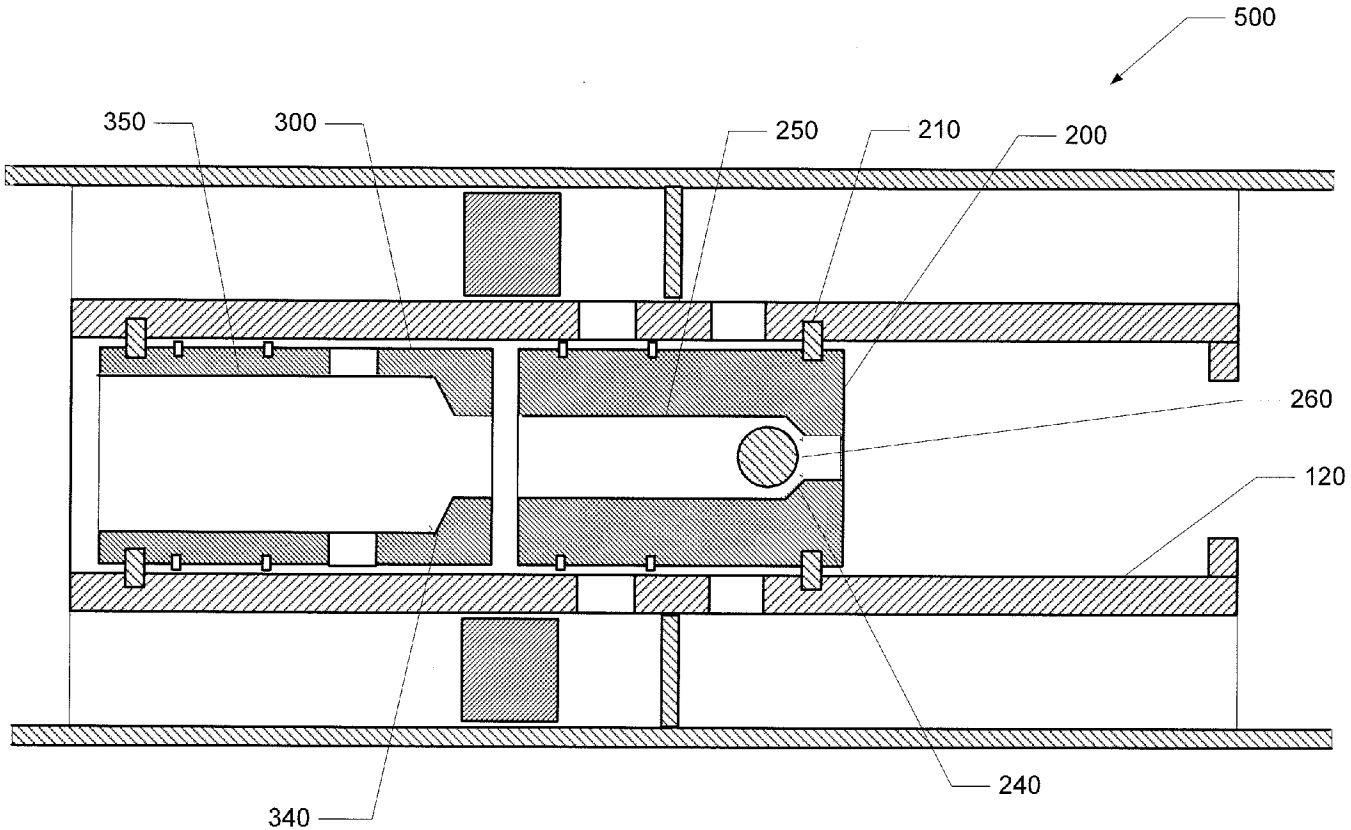
FIG. 2 shows a cross-sectional view of a second state of a downhole tool in accordance with an embodiment of the present disclosure.

FIG. 2 depicts a second state of the tool 500, in accordance with embodiments disclosed herein. Prior to the state shown in FIG. 2, an operator seeking to actuate the tool 500 may drop a first drop object 260 into the well. The first drop object 260 travels down the well (by gravity, fluid pressure, etc.) to reach the tool 500. In one or more embodiments, the first drop object 260 is sized to be smaller than the second sleeve throughbore 350, the second seat 340, and the first sleeve throughbore 250 such that the first drop object 260 may pass through the first sleeve 200. Further, the first drop object 260 is configured to seat within the first seat 240. Accordingly, FIG. 2 depicts a second state where, upon reaching the tool 500, the first drop object 260 has passed through the second sleeve 300 and has seated in the first seat 240.

In one or more embodiments, the first seat 240 is axially aligned with the first sleeve throughbore 250, and is configured to receive the first drop object 260. In particular, the first drop object 260 may be configured to sit within the first seat 240 so as to prevent fluid flow through the first sleeve throughbore 250. For example, in one embodiment, the first seat 240 may be a circular opening, and the first drop object 260 may be a drop ball having a predefined diameter sized to be received within the first seat 240. Alternatively, the first drop object 260 may be any type of object configured to be received within the first seat 240 (e.g., a dart, a spike, and the like).

In one or more embodiments, the first seat 240 may be replaceable and may be removably coupled to the first sleeve 200 by any method known in the art. For example, the first seat 240 may be a separate sleeve having a seat and disposed within the first sleeve 200 by, for example, a threaded connection, press fit, etc. Thus, the first seat 240 may be replaced to accommodate the use of a first drop object 260 of various sizes and/or configurations.

Once the first drop object 260 has seated into the first seat 240, the fluid flow 600 through the tool 500 is blocked. Accordingly, a hydraulic pressure is applied against the first drop object 260, resulting in a downward force on the first sleeve 200. For example, a surface pump (not shown) may pressurize the fluid above the tool 500, thereby applying a determined hydraulic pressure on the first drop object 260.

As discussed above, the first shearing device 210 is configured to maintain the first sleeve 200 in a first position until a first predetermined pressure from above is reached. Accordingly, when the hydraulic pressure on the first sleeve 200 reaches the first predetermined pressure, the first shearing device 210 shears or breaks and releases the first sleeve 200. Once released, the first sleeve 200 is pushed axially down the throughbore 120 by the hydraulic pressure to a second position, as described below with reference to FIG. 3.

Figure 3:
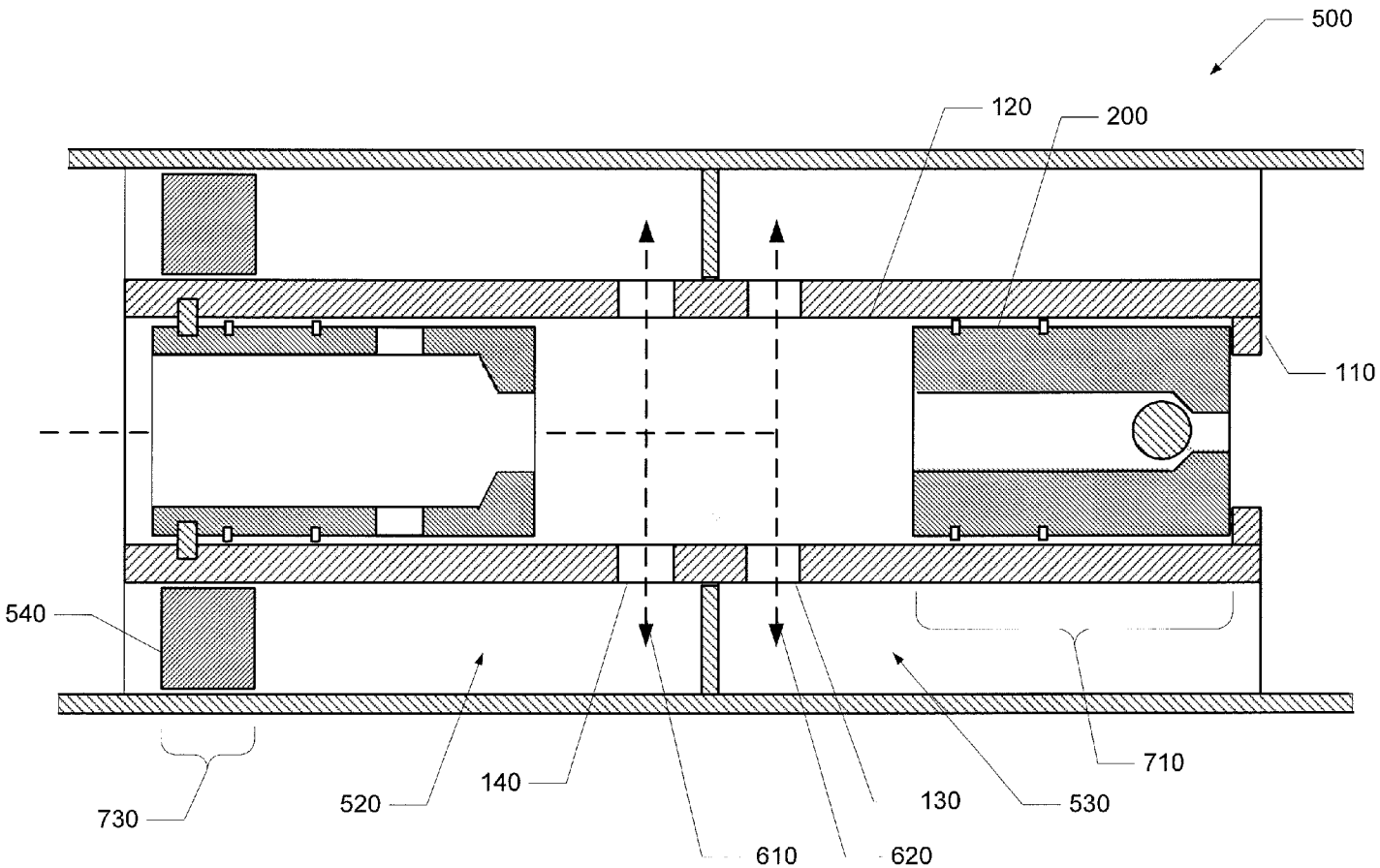
FIG. 3 shows a cross-sectional view of a third state of a downhole tool in accordance with an embodiment of the present disclosure.

FIG. 3 depicts a third state of the tool 500, in accordance with embodiments disclosed herein. Specifically, FIG. 3 depicts a third state in which the first sleeve 200 has been moved down the throughbore 120 by the hydraulic pressure to a first stop position 710. In one or more embodiments, the first stop position 710 may be a location within the mandrel 100 at which the first sleeve 200 comes into contact with the shoulder 110.

As shown in FIG. 3, when located in the first stop position 710, the first sleeve 200 no longer blocks the bypass ports 130. Accordingly, fluid flow 620 can pass from the throughbore 120 to the bypass chamber 530. In one or more embodiments, the fluid flow 620 may pass into the bypass chamber 530 and then continue downhole.

In addition, when located in the first stop position 710, the first sleeve 200 no longer blocks the activation ports 140. Accordingly, fluid flow 610 can pass from the throughbore 120 to the piston chamber 520. In one or more embodiments, the fluid flow 610 entering the piston chamber 520 may exert a hydraulic pressure against the piston 540, thereby pushing the piston 540 through the piston chamber 520 to an activation position 730. In one or more embodiments, moving the piston 540 to the activation position 730 actuates component(s) (not shown) of the tool 500, or actuates another downhole tool (not shown) coupled to the tool 500. For example, in an embodiment where the tool 500 is an underreamer or stabilizer, moving the piston 540 to the activation position 730 may cause reamer arms and/or stabilizer blades (not shown) to extend radially from the tool 500.

Figure 4:
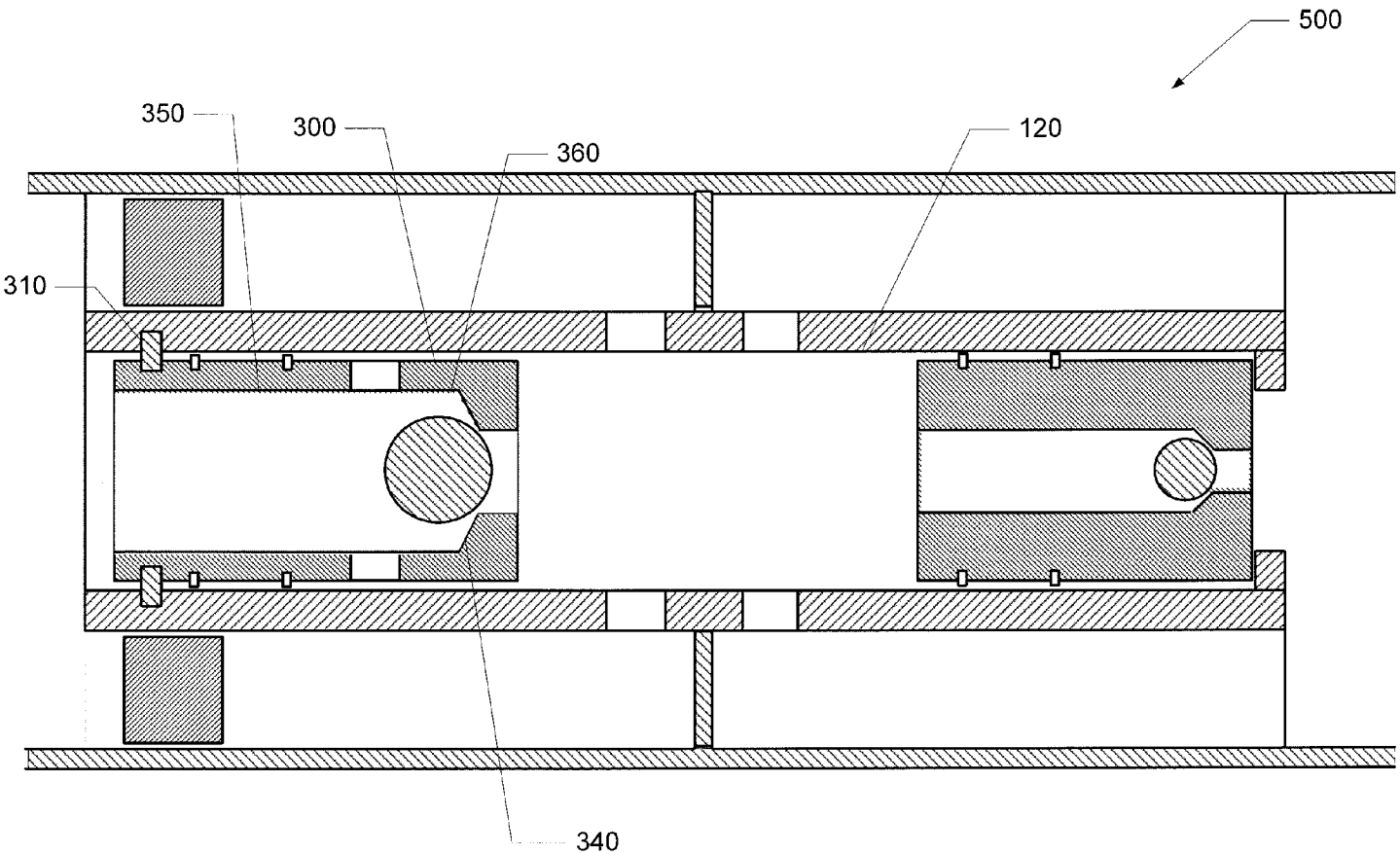
FIG. 4 shows a cross-sectional view of a fourth state of a downhole tool in accordance with an embodiment of the present disclosure.
Figure 5:
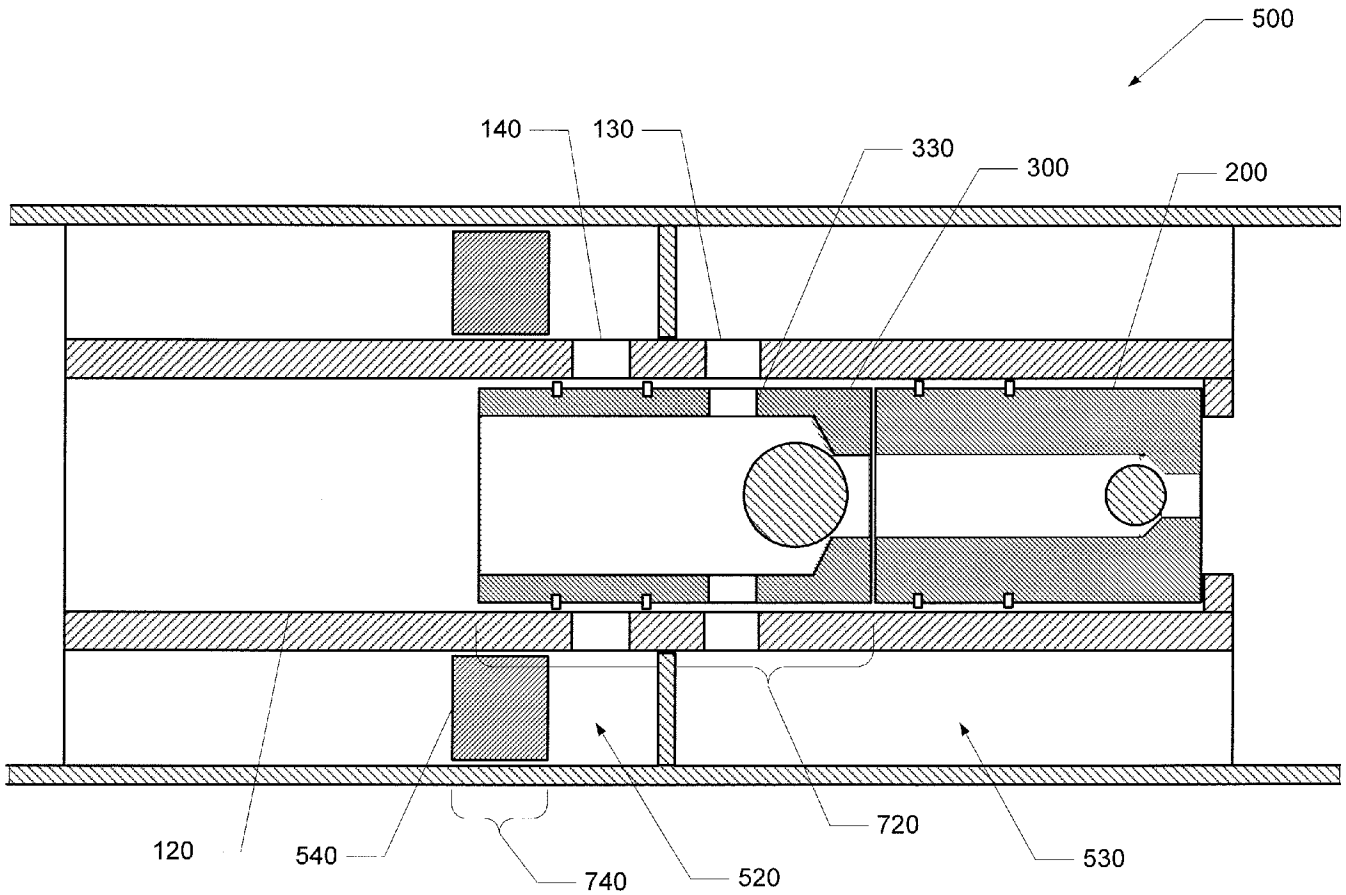
FIG. 5 shows a cross-sectional view of a fifth state of a downhole tool in accordance with an embodiment of the present disclosure.

FIG. 4 depicts a fourth state of the tool 500, in accordance with embodiments disclosed herein. To de-actuate the tool 500, a second drop object 360 may be dropped into the well. The second drop object 360 travels down the well (by gravity, fluid pressure, etc.) to reach the tool 500. In one or more embodiments, the second drop object 360 is configured to pass into the second sleeve throughbore 350 and to seat within the second seat 340. Accordingly, FIG. 5 depicts the state where, upon reaching the tool 500, the second drop object 360 has passed into the second sleeve throughbore 350 and has seated in the second seat 340.

In one or more embodiments, the second seat 340 is axially aligned with the second sleeve throughbore 350, and is configured to receive the second drop object 360. In particular, the second drop object 360 may be configured to sit within the second seat 340 so as to prevent fluid flow through the second sleeve throughbore 350. For example, in one embodiment, the second seat 340 may be a circular opening, and the second drop object 360 may be a drop ball having a predetermined diameter sized to be received within the second seat 340 (i.e., the diameter of the second drop ball is greater than the circular opening). Further, the first seat 240 may also be a circular opening, and the first drop object 260 may be a drop ball having a predetermined diameter sized to be received within the first seat 240 (i.e., the diameter of the first drop ball is greater than the circular opening). Note that the diameter of the second seat 340 is larger than the diameter of the first seat 240, such that the first drop object 260 can pass through the second sleeve 200, but the second drop object 360 is restricted by the second sleeve 200. Alternatively, the first drop object 260 and the second drop object 360 may be any type of object configured to be received within the second seat 340 (e.g., a dart, a spike, and the like).

In one or more embodiments, the second seat 340 may be replaceable and may be removably coupled to the second sleeve 300 by any method known in the art. For example, the second seat 340 may be a separate sleeve having a seat and disposed within the second sleeve 300 by, for example, a threaded connection, press fit, etc. Thus, the second seat 340 may be replaced to accommodate the use of a second drop object 360 of various sizes and/or configurations.

Once the second drop object 360 is seated within the second seat 340, the fluid flow 600 (shown in FIG. 1) through the tool 500 is again blocked. Accordingly, a hydraulic pressure is applied against the second drop object 360, resulting in a downward force on the second sleeve 300. For example, a surface pump (not shown) may pressurize the fluid above the tool 500, thereby applying a given hydraulic pressure on the second drop object 360.

As discussed above, the second shearing device 310 is configured to maintain the second sleeve 300 in a first position until a second predetermined pressure from above is reached. Accordingly, when the hydraulic pressure on the second drop object 360 reaches the second predetermined pressure, the second shearing device 310 shears or breaks and releases the second sleeve 300. Once released, the second sleeve 300 is pushed axially down the throughbore 120 by the hydraulic pressure to a second position, as described below with reference to FIG. 5. In this embodiment, the first predetermined pressure is less than the second predetermined pressure. However, one of ordinary skill in the art will appreciate that the first predetermined pressure may be greater than the second predetermined pressure or equal to the second predetermined pressure.

FIG. 5 depicts a fifth state of the tool 500, in accordance with embodiments disclosed herein. Specifically, FIG. 5 depicts a fifth state in which the second sleeve 300 has been moved down the throughbore 120 by the hydraulic pressure to a second stop position 720. In one or more embodiments, the second stop position 720 may be the location within the mandrel 100 at which the second sleeve 300 comes into a shoulder contact with the first sleeve 200.

As shown in FIG. 5, when located in the second stop position 720, the second sleeve 300 blocks the activation ports 140. Accordingly, fluid no longer flows from the throughbore 120 to the piston chamber 520, and the piston 540 is thus no longer actuated or pushed up the piston chamber 520. In one or more embodiments, a biasing member (e.g., a biasing spring) (not shown) may exert a downward force on the piston 540, thereby moving the piston 540 to a deactivation position 740. In other embodiments, a pressure differential created by closing the activation ports 140 may cause the piston 540 to return to the deactivation position 740. Moving the piston 540 to the deactivation position 740 de-actuates component(s) of the tool 500, or de-actuates another downhole tool (not shown) coupled to the tool 500. For example, in an embodiment where the tool 500 is an underreamer or stabilizer, moving the piston 540 to the deactivation position 740 may cause reamer arms and/or stabilizer blades (not shown) to retract into the tool 500.

Further, when located in the second stop position 720, radial ports 330 of the second sleeve 300 align with the bypass ports 130. Accordingly, fluid flow 620 may continue to pass from the throughbore 120 to the bypass chamber 530 and continue downhole.

FIGS. 6-11 depict cross-sectional views of a control mechanism for actuating and de-actuating a tool 505, in accordance with another embodiment of the present disclosure. Specifically, FIGS. 6-11 depict the components of the tool 505 at multiple stages time in accordance with one embodiment.

Figure 6:
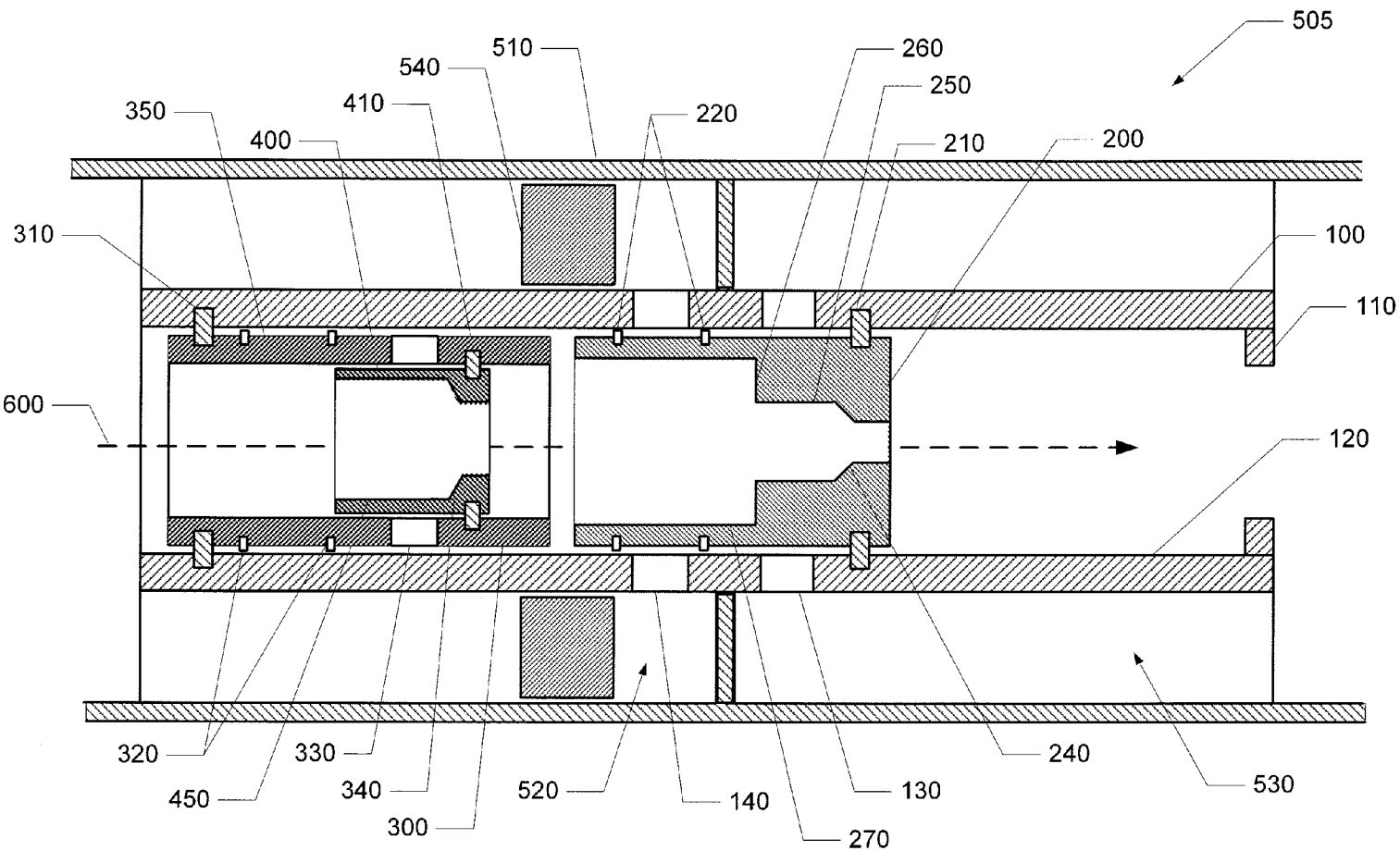
FIG. 6 shows a cross-sectional view of a first state of a downhole tool in accordance with another embodiment of the present disclosure.

FIG. 6 depicts an initial state of the tool 505 located in a well, in accordance with embodiments disclosed herein. Many components of the tool 505 shown in FIG. 6 are the same as the components of the tool 500 shown in FIGS. 1-5, and those components maintain the same reference numerals. Specifically, the tool 505 also includes a mandrel 100, a piston 540, a piston chamber 520, and a bypass chamber 530. The mandrel 100 includes a shoulder 110, a throughbore 120, one or more activation ports 140, and one or more bypass ports 130. The mandrel 100 also includes a first sleeve 200 and a second sleeve 300. The first sleeve 200 is initially coupled to the mandrel 100 by a first shearing device 210. The first sleeve 200 includes a first sleeve throughbore 250, a first seat 240 and one or more seals 220. The second sleeve 300 is initially coupled to the mandrel 100 by a second shearing device 310 at a location axially upward from the first sleeve 200. The second sleeve 300 includes a second sleeve throughbore 350, one or more radial ports 330, and one or more seals 320.

In the embodiment shown, the tool 505 further includes a third sleeve 400 disposed within the second sleeve throughbore 350. The third sleeve 400 includes a third sleeve throughbore 450, and is configured to slide axially within the second sleeve throughbore 350 when a predetermined pressure is applied from above the tool 505. The third sleeve 400 is initially coupled to the inner surface of the second sleeve 300 by a third shearing device 410. The third shearing device 410 may be any device (or combination of devices) configured to maintain the third sleeve 400 in an initial position within the second sleeve throughbore 350 until a third predetermined pressure is applied from above the tool 505. The initial position of the third sleeve 400 is such that the radial ports 330 of the second sleeve 300 are blocked by the third sleeve 400.

As shown in FIG. 6, the first sleeve 200 includes a cavity 270 configured to receive the third sleeve 400 after it has passed through the second sleeve throughbore 350. The cavity 270 is disposed proximate to the upper portion of the second sleeve 200, and is axially aligned with the third sleeve throughbore 450. In one or more embodiments, the first sleeve 200 may include a lower shoulder 260 configured to stop the axial motion of the third sleeve 400. As shown, the second seat 340 is disposed in the third sleeve 400.

Figure 7:
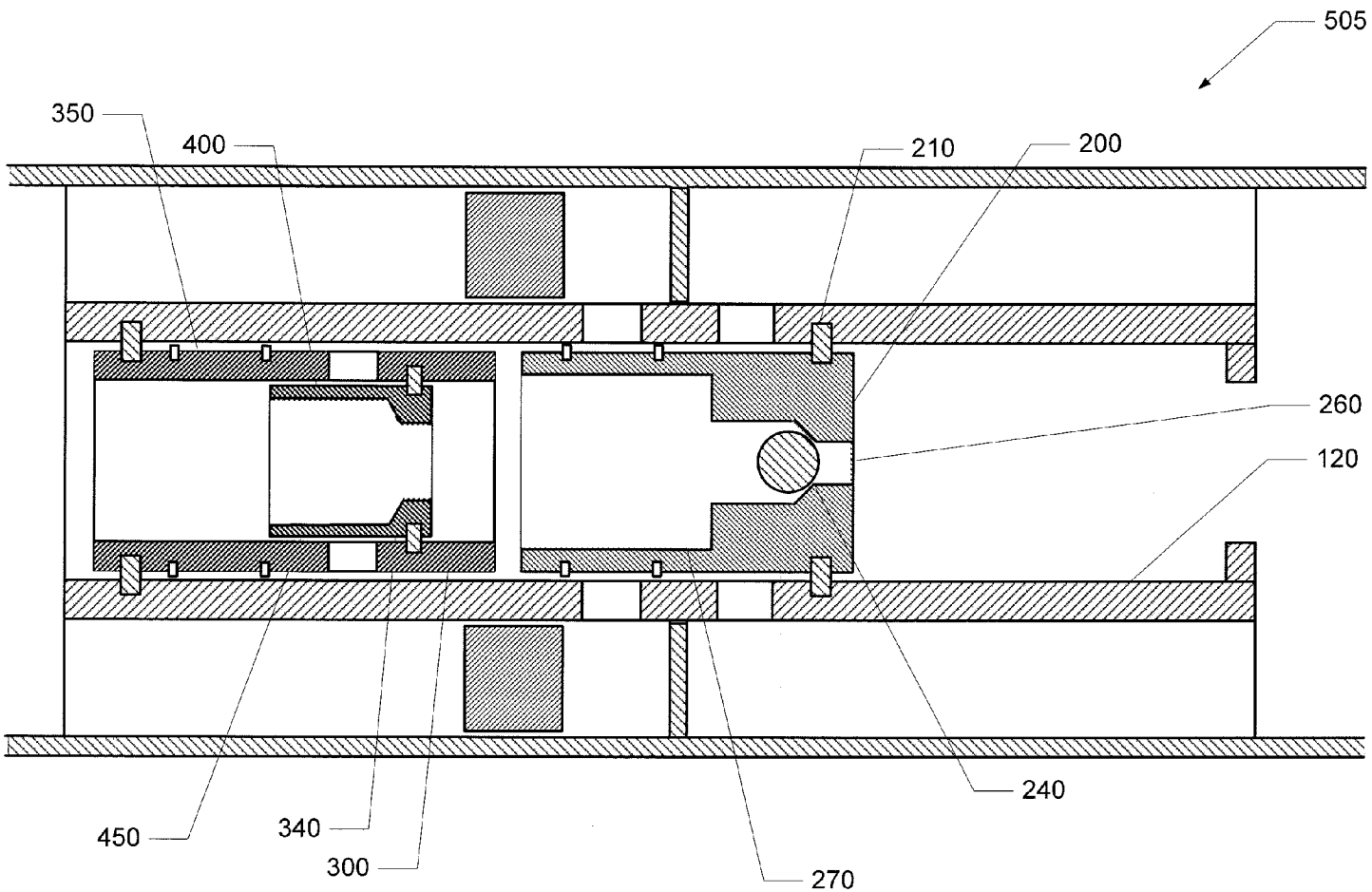
FIG. 7 shows a cross-sectional view of a second state of a downhole tool in accordance with another embodiment of the present disclosure.

FIG. 7 depicts a second state of the tool 505, in accordance with embodiments disclosed herein. To actuate the tool 505, first drop object 260 is dropped into the well. The first drop object 260 travels down the well (by gravity, fluid pressure, etc.) to reach the tool 505. In this embodiment, the first drop object 260 is sized to be smaller than the second sleeve throughbore 350, the third sleeve throughbore 450, the second seat 340, the cavity 270, and the first sleeve throughbore 250. Further, the first drop object 260 is configured to sit in or seal against the first seat 240. Accordingly, FIG. 7 depicts the state where, upon reaching the tool 505, the first drop object 260 has passed completely through the second sleeve 300 and the third sleeve 400, and has seated into the first seat 240.

Once the first drop object 260 is seated in the first seat 240, the fluid flow 600 through the tool 505 is blocked. A hydraulic pressure is then applied against the first drop object 260, resulting in a downward force on the first sleeve 200. When the hydraulic pressure on the first sleeve 200 reaches the first predefined pressure, the first shearing device 210 shears or breaks and releases the first sleeve 200. Once released, the first sleeve 200 is pushed axially down the throughbore 120 by the hydraulic pressure to a second location, as described below with reference to FIG. 8.

Figure 8:
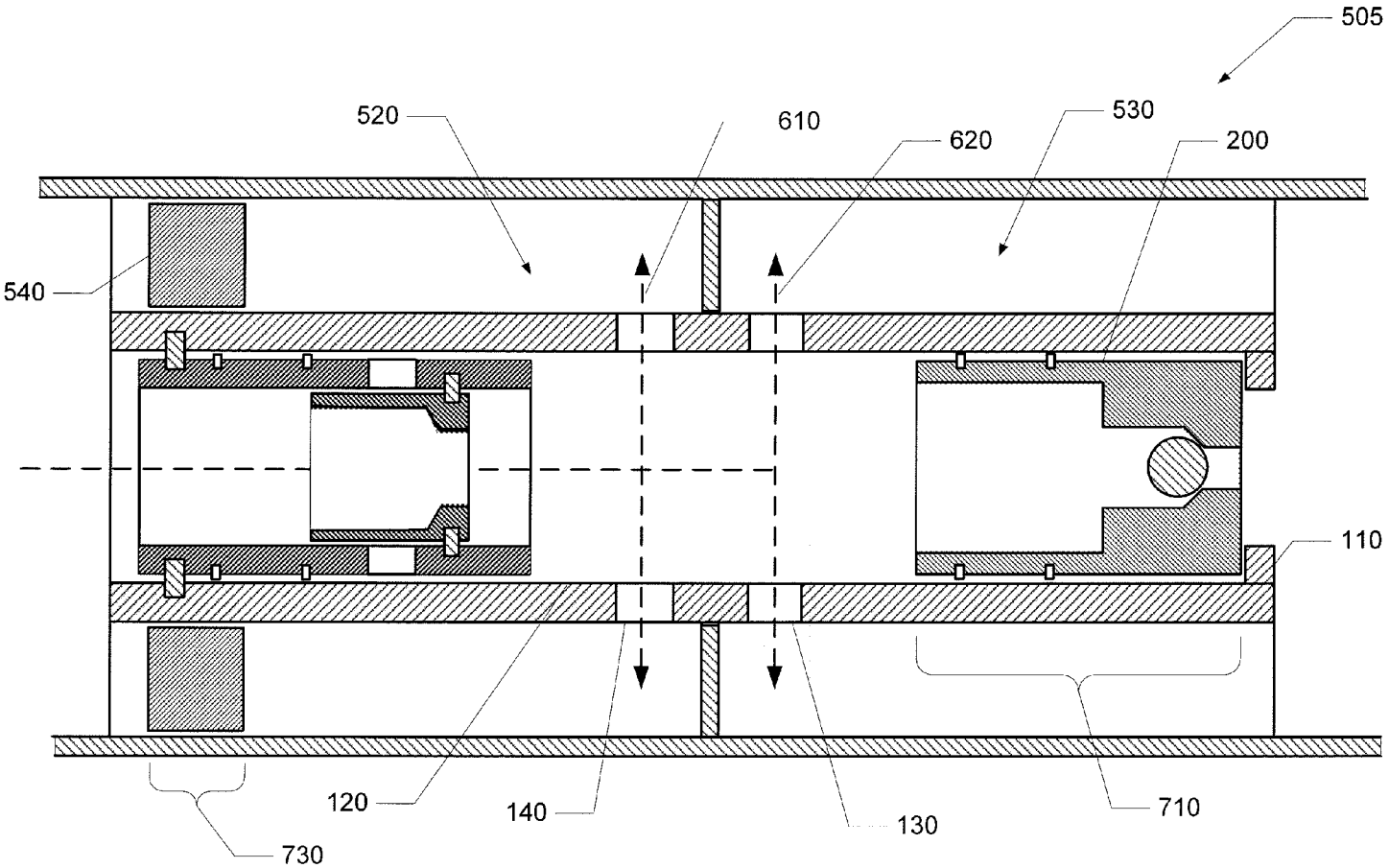
FIG. 8 shows a cross-sectional view of a third state of a downhole tool in accordance with another embodiment of the present disclosure.

FIG. 8 depicts a third state of the tool 505, in accordance with embodiments disclosed herein. Specifically, FIG. 8 depicts a third state in which the first sleeve 200 has been moved down the throughbore 120 to the first stop position 710. In the first stop position 710, the first sleeve 200 no longer blocks the bypass ports 130. Accordingly, fluid flow 620 can pass from the throughbore 120 to the bypass chamber 530. In one or more embodiments, the fluid flow 620 may pass into the bypass chamber 530 and then continue downhole.

In addition, when located in the first stop position 710, the first sleeve 200 no longer blocks the activation ports 140. Accordingly, fluid flow 610 can pass from the throughbore 120 to the piston chamber 520. In one or more embodiments, the fluid flow 610 entering the piston chamber 520 may exert a hydraulic pressure against the piston 540, thereby pushing the piston 540 through the piston chamber 520 to an activation position 730. In one or more embodiments, moving the piston 540 to the activation position 730 actuates component(s) (not shown) of the tool 505, or actuates another downhole tool (not shown) coupled to the tool 505. For example, in an embodiment where the tool 505 is an underreamer or stabilizer, moving the piston 540 to the activation position 730 may cause reamer arms and/or stabilizer blades (not shown) to extend radially from the tool 505.

Figure 9:
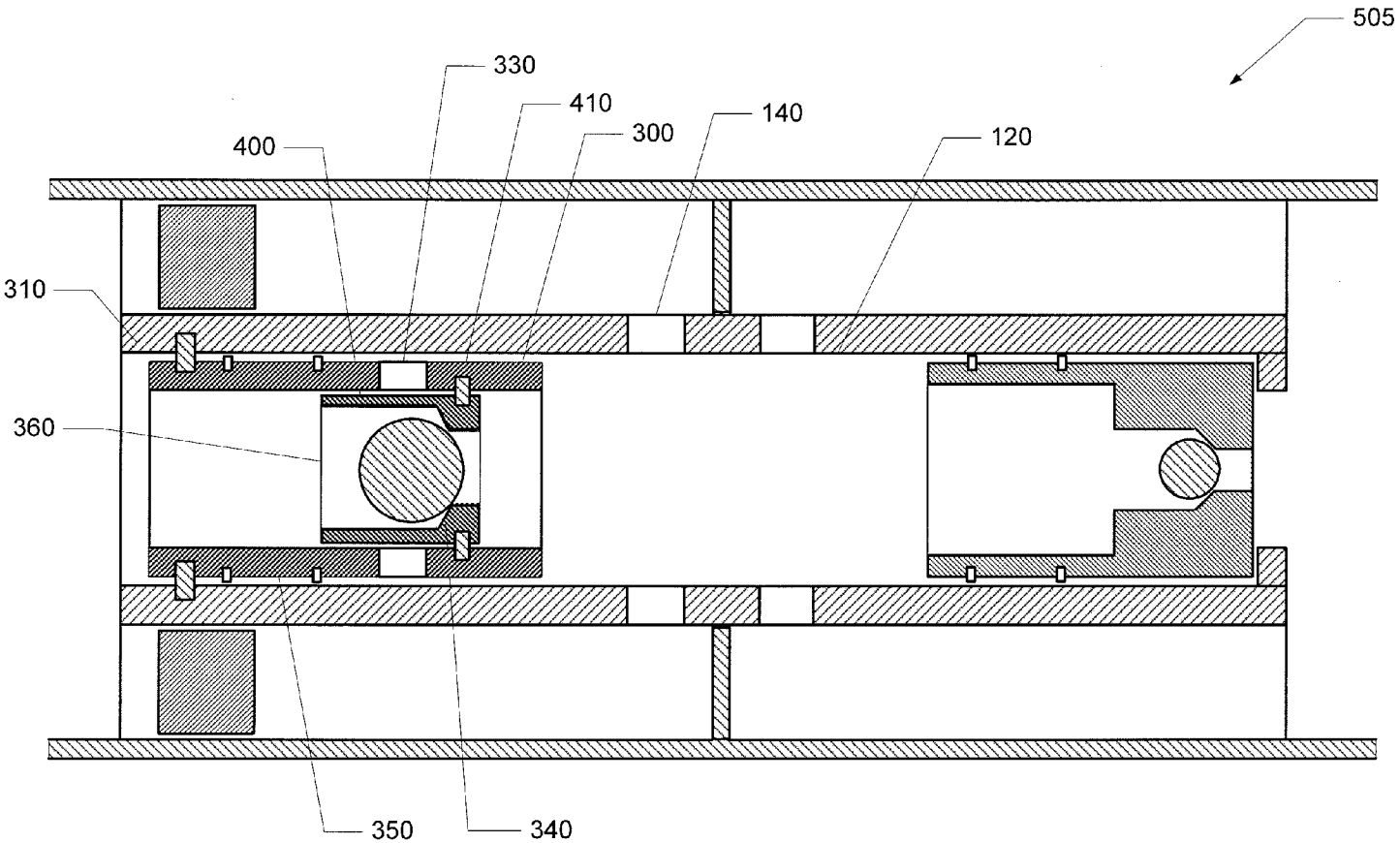
FIG. 9 shows a cross-sectional view of a fourth state of a downhole tool in accordance with another embodiment of the present disclosure.

FIG. 9 depicts a fourth state of the tool 505, in accordance with embodiments disclosed herein. To de-actuate the tool 505, a second drop object 360 may be dropped into the well. The second drop object 360 travels down the well (by gravity, fluid pressure, etc.) to reach the tool 505. In one or more embodiments, the second drop object 360 is configured to enter the second sleeve throughbore 350, and to seat in the second seat 340. Accordingly, FIG. 9 depicts the state where, upon reaching the tool 505, the second drop object 360 has seated into the second seat 340.

Once the second drop object 360 is seated in the second seat 340, the fluid flow 600 through the tool 500 is again blocked. A hydraulic pressure is then applied against the second drop object 360, resulting in a downward force on the third sleeve 400. Further, because the third sleeve 400 is coupled to the second sleeve 300 by the third shearing device 410, the hydraulic pressure is also applied to the second sleeve 300. As discussed above with reference to the embodiment shown in FIG. 1, the second shearing device 310 is configured to maintain the second sleeve 300 coupled to the mandrel 100 until a second predetermined pressure is applied from above. Further, as discussed above with reference to FIG. 7, the third shearing device 410 is configured to maintain the third sleeve 400 coupled to the second sleeve 300 until a third predetermined pressure is applied from above.

In this embodiment, the second shearing device 310 is configured to break or shear before the third shearing device 410 (i.e., the second predetermined pressure is less than the third predetermined pressure). Accordingly, as the hydraulic pressure is increased, the hydraulic pressure reaches the second predetermined pressure first, at which time the second shearing device 310 releases the second sleeve 300. Once released, the second sleeve 300 (and the third sleeve 400 engaged therein) is pushed axially down the throughbore 120 by the hydraulic pressure to a second position, as described below with reference to FIG. 10.

Figure 10:
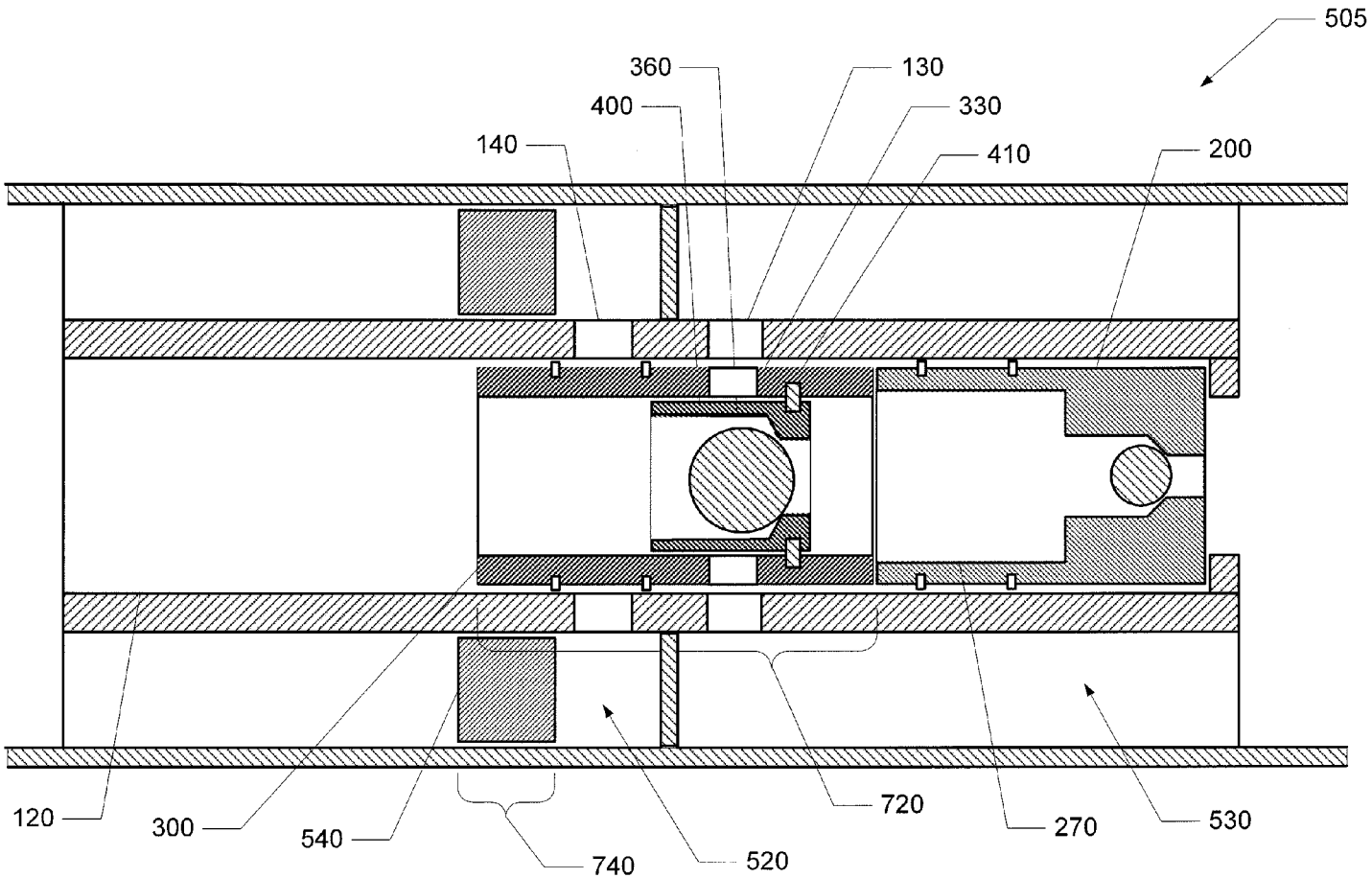
FIG. 10 shows a cross-sectional view of a fifth state of a downhole tool in accordance with another embodiment of the present disclosure.

FIG. 10 depicts a fifth state of the tool 505, in accordance with embodiments disclosed herein. Specifically, FIG. 10 depicts a fifth state in which, after the second predetermined pressure has been reached, the second sleeve 300 has been moved down the throughbore 120 by the hydraulic pressure to a second stop position 720. In one or more embodiments, the second stop position 720 may be the location within the throughbore 120 at which the second sleeve 300 comes into contact with the first sleeve 200. Note that, because the hydraulic pressure has not yet reached the third predefined pressure, the sleeve 300 remains coupled to the third sleeve 400.

As shown in FIG. 10, when located in the second stop position 720, the second sleeve 300 blocks the activation ports 140. Thus, fluid no longer flows from the throughbore 120 to the piston chamber 520. Accordingly, the piston 540 returns to the deactivation position 740, thereby de-actuating component(s) (not shown) of the tool 505, or de-actuating another downhole tool (not shown) coupled to the tool 505. Further, when located in the second stop position 720, the radial ports 330 of the second sleeve 300 align with the bypass ports 130. However, the radial ports 330 are blocked by the third sleeve 400. Thus, fluid can no longer flow into the bypass chamber 530.

Note that, as the second sleeve 300 moves from an initial position (shown in FIG. 9) to the second stop position 720 (shown in FIG. 10), the second sleeve 300 temporarily moves into a position (not shown) where the radial ports 330 come into alignment with the activation ports 140. While the second sleeve 300 is in such a position, any fluid flow passing through the radial ports 330 and the activation ports 140 into the piston chamber 520 could reduce the hydraulic pressure acting on the second sleeve 300, thus causing the second sleeve 300 to stop moving before reaching the second stop position 720. However, in this embodiment, the third sleeve 400 blocks any fluid flow from passing through the radial ports 330 when they are in alignment with the activation ports 140. Accordingly, the use of the third sleeve 400 may advantageously prevent the second sleeve 300 from stopping prior to reaching the second stop position 720.

Figure 11:
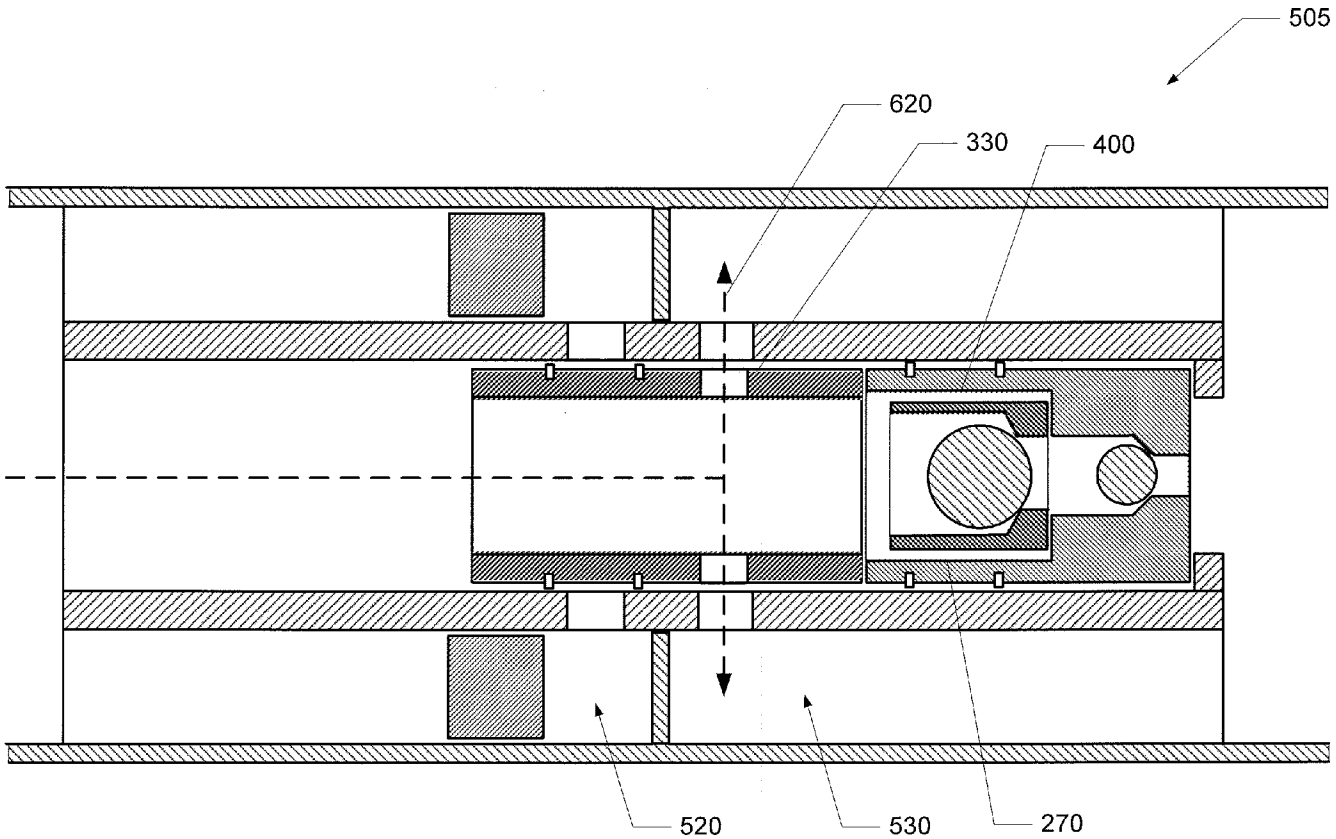
FIG. 11 shows a cross-sectional view of a sixth state of a downhole tool in accordance with another embodiment of the present disclosure.

FIG. 11 depicts a sixth state of the tool 505, in accordance to the second embodiment of the present invention. Specifically, FIG. 11 depicts a sixth state in which the hydraulic pressure on the second drop object 360 has increased until reaching the third predefined pressure, at which time the third shearing device 410 has sheared or broken and released the third sleeve 400. Once released, the third sleeve 400 has been pushed axially down through the second sleeve throughbore 350 and into the cavity 270 by the hydraulic pressure. As shown in FIG. 11, when pushed into the cavity 270, the third sleeve 400 no longer blocks the radial ports 330. Accordingly, fluid can again enter the bypass chamber 530, but not the piston chamber 520.

Figure 12:
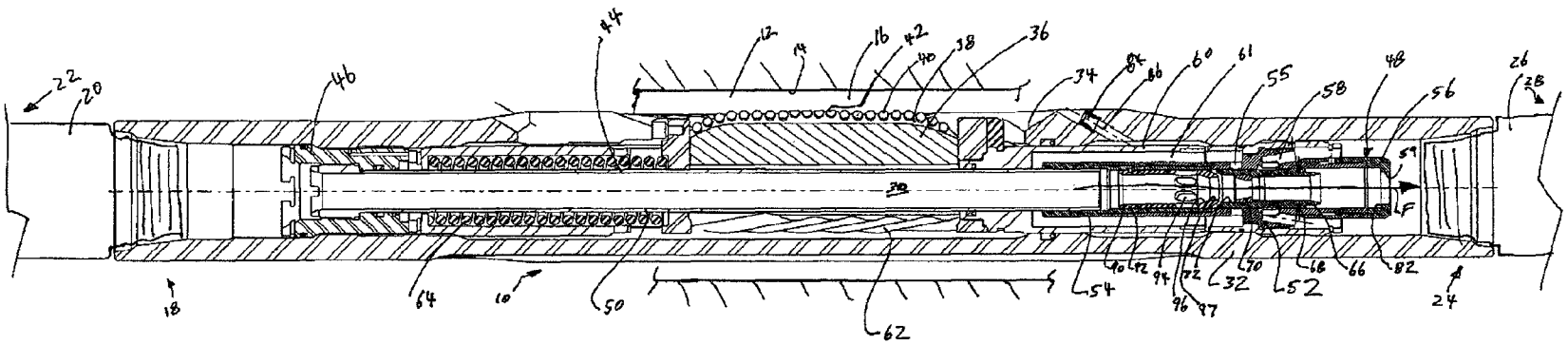
FIG. 12 shows a cross-sectional view of a downhole tool in accordance with an embodiment of the present disclosure.

A method of actuating and de-actuating a downhole tool in accordance with embodiments disclosed herein is now discussed with reference to FIG. 12. The method includes disposing a downhole tool 10 and a control mechanism in a well 12. As shown in FIG. 12, the control mechanism includes a mandrel 44, a first sleeve 66 detachably mounted within a throughbore 30 of the mandrel 44 and including a first seat 70. The control mechanism also includes a second sleeve 90 detachably mounted within the throughbore 30 and including a second seat 96. The mandrel 44 includes at least one activation port 55 initially blocked by the first sleeve 66. The method includes dropping a first drop object (not shown) of a first size into the well 12, and seating the first drop object in the first seat 70. The method also includes applying a first predetermined hydraulic force against the first drop object to move the first sleeve 66 axially downward within the mandrel 44 to a first stop position. Moving the first sleeve to the first stop position opens the at least one activation port 55. Fluid flows through the at least one activation port 55 to actuate the downhole tool 10. Specifically, in one or more embodiments, fluid passes through the activation port 55 into a piston chamber 61 and displaces a piston 60, thereby actuating the downhole tool 10. The method also includes dropping a second drop object (not shown) of a second size into the well 12, and seating the second drop object in the second seat 96. A second predetermined hydraulic force is applied against the second drop object to move the second sleeve 90 axially downward within the mandrel 44 to a second stop position. Moving the second sleeve 90 to the second stop position blocks the at least one activation port 55, thereby deactuating the downhole tool 10. Radial ports of the second sleeve align with bypass ports in the tool to allow fluid flow around the blocked seats of the sleeves.

Advantageously, embodiments disclosed herein provide a control mechanism and method for selectively actuating and de-actuating a downhole tool on demand. Specifically, the downhole tool may be actuated by dropping a first drop object into a well, and may be de-actuated by dropping a second drop object into the well. Additionally, embodiments disclosed herein provide full fluid flow through the downhole tool when the tool is either actuated or de-actuated.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A control mechanism for a downhole tool comprising:

a mandrel comprising a throughbore, at least one activation port, and at least one bypass port;

a first sleeve detachably mounted to the mandrel and configured to slide axially within the throughbore from a first position to a second position, the first sleeve comprising a first seat;

a second sleeve detachably mounted to the mandrel and configured to slide axially within the throughbore from a third position located axially above the first position to a fourth position, the second sleeve including a second seat;

a piston chamber disposed proximate and radially outward an upper portion of the mandrel; and a piston disposed in the piston chamber, wherein the piston is moveable by a hydraulic force to actuate the downhole tool.

2. The control mechanism of claim 1, wherein the first sleeve at the first position blocks the at least one activation port and the at least one bypass port, and wherein the first sleeve at the second position opens the at least one activation port and the at least one bypass port.

3. The control mechanism of claim 1, wherein the second sleeve at the fourth position blocks the at least one activation port without blocking the at least one bypass port.

4. The control mechanism of claim 1, wherein the first seat has a first diameter and the second seat has a second diameter.

5. The control mechanism of claim 1, wherein the first seat is configured to receive a first drop object and the second seat is configured to receive a second drop object.

6. The control mechanism of claim 5, wherein the first and second drop objects comprise one of a ball and a dart.

7. The control mechanism of claim 5, wherein the first sleeve is detachably mounted to the mandrel with a first shearing device, the first shearing device configured to break when a first predetermined pressure is applied to the first drop object.

8. The control mechanism of claim 7, wherein the second sleeve is detachably mounted to the mandrel with a second shearing device, the second shearing device configured to break when a second predetermined pressure is applied to the second drop object.

9. The control mechanism of claim 8, wherein the first and second shearing devices comprise one selected from a group consisting of a shear pin, a shear ring, a shear bolt, and a shear screw.

10. The control mechanism of claim 1, wherein the at least one activation port passes through a sidewall of the mandrel to allow communication between the throughbore and the piston chamber.

11. The control mechanism of claim 1, wherein the at least one bypass port is located axially downward from the at least one activation port.

12. The control mechanism of claim 1, further comprising:

a third sleeve disposed within the second sleeve and detachably mounted to the second sleeve.

13. A method of hydraulically actuating and deactuating a downhole tool, the method comprising:

disposing the downhole tool and a control mechanism in a well, wherein the control mechanism comprises a mandrel, a first sleeve detachably mounted to the mandrel and configured to slide axially within a throughbore of the mandrel and comprising a first seat, and a second sleeve detachably mounted to the mandrel and configured to slide axially within the throughbore and comprising a second seat, wherein the mandrel comprises at least one activation port initially blocked by the first sleeve, and wherein the mandrel further includes at least one bypass port;

dropping a first drop object of a first size into the well;

seating the first drop object in the first seat;

applying a first predetermined hydraulic force against the first drop object to move the first sleeve axially downward within the mandrel to a first stop position, wherein moving the first sleeve to the first stop position opens the at least one activation port;

flowing a fluid through the at least one activation port to actuate the downhole tool;

dropping a second drop object of a second size into the well;

seating the second drop object in the second seat; and applying a second predetermined hydraulic force against the second drop object to move the second sleeve axially downward within the mandrel to a second stop position, wherein moving the second sleeve to the second stop position blocks the at least one activation port.

14. The method of claim 13, wherein moving the first sleeve to the first stop position opens the at least one bypass port.

15. The method of claim 13, wherein the second sleeve comprises at least one lateral port.

16. The method of claim 13, wherein moving the second sleeve to the second stop position aligns the at least one lateral port with the at least one bypass port.

17. The method of claim 13, wherein moving the first sleeve to the first stop position comprises shearing a first shearing device.

18. The method of claim 13, wherein moving the second sleeve to the second stop position comprises shearing a second shearing device.

19. The method of claim 13, wherein the downhole tool is a reamer.

20. A control mechanism for a downhole tool comprising:

a mandrel comprising a throughbore, at least one activation port, and at least one bypass port;

a first sleeve detachably mounted to the mandrel and configured to slide axially within the throughbore from a first position to a second position, the first sleeve comprising a first seat;

a second sleeve detachably mounted to the mandrel and configured to slide axially within the throughbore from a third position located axially above the first position and moveable to a fourth position; and a third sleeve detachably mounted to the second sleeve and configured to slide axially within the second sleeve, the third sleeve including a second seat.

* * * * *

UNITED STATES PATENT AND TRADEMARK OFFICE

CERTIFICATE OF CORRECTION

PATENT NO. : 8,555,983 B2
APPLICATION NO. : 12/945439
DATED : October 15, 2013
INVENTOR(S) : Arturo Palacios, Jr.

It is certified that error appears in the above-identified patent and that said Letters Patent is hereby corrected as shown below:

On the Title Page, Item (75) Inventor: Arturo Palacios should read --Arturo Palacios, Jr.--.

Signed and Sealed this
Thirtieth Day of June, 2015

Michelle K. Lee

Michelle K. Lee
*Director of the United States Patent and Trademark Office*